US005535656A

United States Patent [19]

Pummell et al.

[11] Patent Number: 5,535,656

[45] Date of Patent: Jul. 16, 1996

[54] FLEXIBLE GUILLOTINES

[75] Inventors: Leslie J. H. Pummell, Rickmansworth; Paul C. Ward, Oxhey; Stephen J. Kingdon, St. Albans; James A. Oldfield, Great Missenden, all of United Kingdom

[73] Assignee: Eastman Kodak Company, Rochester, N.Y.

[21] Appl. No.: 289,332

[22] Filed: Aug. 11, 1994

Related U.S. Application Data

[63] Continuation of Ser. No. 36,618, Mar. 24, 1993, abandoned.

[30] Foreign Application Priority Data

Mar. 24, 1992 [GB] United Kingdom ..... 9206346

[51] Int. Cl.[6] ..... B26D 1/08; B26D 5/14; B65H 35/04

[52] U.S. Cl. ..... 83/580; 83/628; 83/694; 83/821; 83/948; 242/526

[58] Field of Search ..... 83/582, 542, 580, 83/628, 635, 821, 948, 694; 173/47; 242/526

[56] References Cited

U.S. PATENT DOCUMENTS

| | | | |
|---|---|---|---|
| 3,545,327 | 12/1970 | Dorman | 83/542 |
| 3,777,609 | 12/1973 | Michel et al. | 83/635 |
| 4,048,891 | 9/1977 | Pearl | 83/628 X |
| 4,094,726 | 6/1978 | Hujer et al. | 156/502 |
| 4,119,047 | 10/1978 | Spanel et al. | 112/79 |
| 4,307,955 | 12/1981 | Cocco et al. | 354/303 |
| 4,604,929 | 8/1986 | Vallance | 83/628 X |
| 4,879,935 | 11/1989 | Gerber | 83/628 X |
| 5,056,394 | 10/1991 | Manschwetus | 83/694 |

FOREIGN PATENT DOCUMENTS

| | | |
|---|---|---|
| 0160349 | 11/1985 | European Pat. Off. . |
| 1093670 | 11/1960 | Germany . |
| 2231299 | 11/1990 | United Kingdom . |

*Primary Examiner*—Rinaldi I. Rada
*Assistant Examiner*—Clark F. Dexter
*Attorney, Agent, or Firm*—Frank Pincelli

[57] ABSTRACT

It is known to use the leading edge of a film strip to guide the strip through processing apparatus. However, this leading edge may be damaged as the film is loaded into and unloaded out of a camera. Described herein is a film unloading device in which a curved guillotine blade (240) is used to provide a newly cut leading edge by which a film strip can be guided through processing apparatus. The guillotine blade (240) is reciprocated between a rest and an operative position by a motor which operates in one direction only. The blade (240) is mounted on a rotating drum (250) by means of a crank pin (258), the drum being rotated through 180°, in the direction indicated by arrow 252, to move the blade (240) from its rest to its operative position and then through a further 180° to move the blade (240) back to its rest position.

4 Claims, 2 Drawing Sheets

FLEXIBLE GUILLOTINES

This is a continuation of application Ser. No. 08/036,618, filed 24 Mar. 1993, now abandoned.

FIELD OF INVENTION

This invention relates to flexible guillotines and is more particularly concerned with a cutting device for use in a film unloading station of photographic processing apparatus.

BACKGROUND INFORMATION

Most photographic film now used is 35 mm format film. Cameras have been developed to allow film of this format to be easily loaded by placing the film cassette, in which the film is stored, into an opening in the back of the camera and then shutting the back of the camera. As a free end or tongue of the film extends externally to the film cassette, this is used to automatically advance the film in the camera for picture taking. Once all the pictures have been taken, the film is rewound into the film cassette for removal from the camera for processing. In order for this to work, the free end or tongue of the film must extend externally to the cassette so that it can be pulled on to the take-up spool in the camera as the film is first loaded.

Photographic film tends to be processed in a single strip once the film has been removed from its cassette. Strips of negative film are processed by transporting them, either as a single individual strip or as a continuous length comprising two or more strips of shorter lengths, through a series of processing solutions in various tanks in the processing apparatus.

In known processing apparatus, the film strip is pulled through tanks containing the processing solutions either by a leader which is attached to the leading edge of the film strip, or by moving a rack or spiral containing the film strip from tank to tank. Individual film strips may be pre-spliced into a long reel with a leader card at the front end, clipped to a rack, or fed into a spiral.

Where the film strip is attached to a leader, it is unloaded from the cassette and attached to the leader in a manual operation. The leader is then fed into the processing apparatus so that the film can be processed as it is transported through the apparatus.

Operations of splicing the film strips together or attaching the leader to the strip need to be carried out in darkroom conditions due to the sensitive nature of the film.

As an alternative to providing a leader for the film strip, the leading edge of the film may be used as a leader to guide the strip through the processing apparatus. However, this may cause problems as the leading edge of the film may have become damaged during loading and/or unloading of the film into and out of the camera.

It is therefore one object of the present invention to is provide a leaderless arrangement for transporting a film strip through processing apparatus. This is achieved by utilizing a guillotine which cuts the film strip from its supporting spool after it has been fully unwound therefrom.

Guillotine blades are well known for a variety of applications. However, most of these blades are rigid and are substantially planar and have a planar cutting edge. Rigid guillotine blades have the disadvantage that they cannot be used in confined spaces.

U.S. Pat. No. 3,777,609 discloses a trimming device which is used to trim the bottom of hollow plastic bodies after they have been fabricated using extrusion blow moulding techniques. The trimming device includes a movable flexible blade, a mechanism for effecting periodic displacement of the blade and a slide guide which guides the blade during its displacements. The slide guide comprises at least one metal guide which is fixed to the bottom of the mould and which causes the blade to follow the shape at the bottom of the mould during its displacements. The blade is curved to have a shape which is intermediate that of the bottom of the mould and its trajectory outside of the slide guide. In operation, the blade is reciprocated between two positions, a rest position and an operative position.

This arrangement requires complicated linkages to allow the blade to be moved from its rest position to its operative position and back again during the return stroke.

It is therefore a further object of the present invention to provide a movable flexible guillotine blade which overcomes the disadvantages of known flexible guillotine blade arrangements.

SUMMARY OF THE INVENTION

According to one aspect of the present invention, there is provided a cutting device comprising:

a flexible guillotine blade having a cutting edge, the blade being movable between a first position and a second position;

guide means for guiding the movement of the blade between the first and second positions; and drive means for driving the blade between the first and a second positions;

characterized in that the drive means operates in one direction only to move the blade between its first and second positions and then from its second to its first position.

By this arrangement, operational control of the guillotine blade is simpler than prior art arrangements.

Advantageously, the blade is reciprocated by the drive means between its first and second positions.

For a better understanding of the present invention, reference will now be made, by way of example only, to the accompanying drawings in which:

DESCRIPTION OF THE PREFERRED EMBODIMENT

Figure 1:
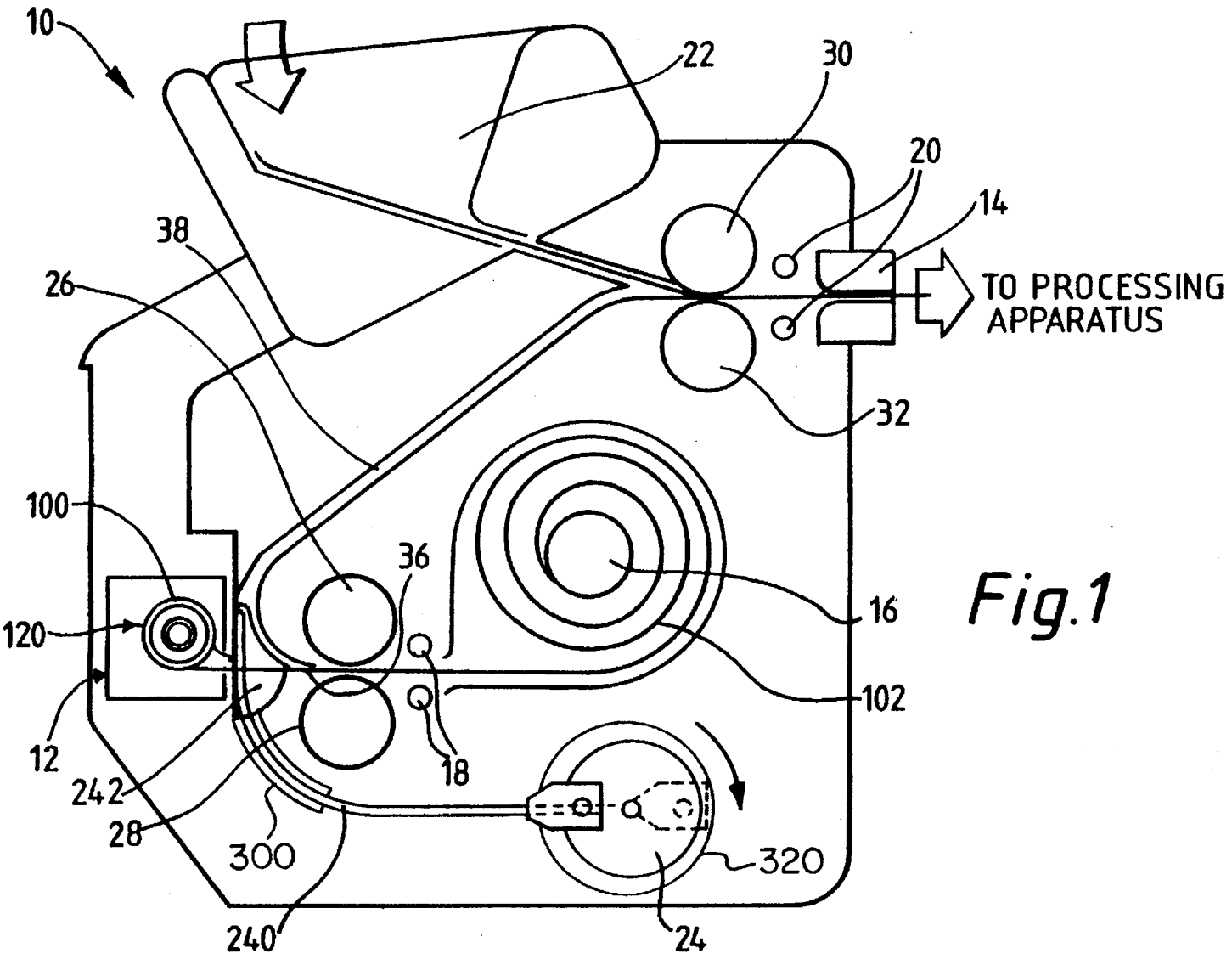
FIG. 1 is a schematic illustration of a loading device for photographic processing apparatus, the device including a guillotine arrangement constructed in accordance with the present invention.

The unloading device 10 shown in FIG. 1 comprises a cassette unloading station 12, a film delivery station 14 connected to processing apparatus (not shown), a storage station 16, a film length checking station 18, a film position checking station 20, a direct film loading station 22, and a blade drive station 24. Pairs of transport rollers 26, 28 and 30, 32 are provided to transport the film through the device 10. These rollers are driven by one or more motors (not shown).

At the cassette unloading station 12, a film cassette 100 is positioned in a cassette-shaped aperture 120 with a free end of the film, otherwise called the film leader or the tongue, extending through the cassette wall. The length of the film leader or tongue is determined by a guide (not shown) which is positioned on the outside of the device 10. A slot 248 (FIG. 2) is arranged in the casing of the device 10 so that the film leader can be introduced into the device 10 and positioned between transport roller pair 26, 28, which are initially spaced apart.

Once the cassette 100 is loaded into the cassette unloading station 12 and the film leader is positioned between roller pair 26, 28, the device 10 can be operated and unloading of the film from its cassette can take place.

Roller 26 is a pinch roller which is movable between a first position in which it is not in contact with roller 28, and a second position in which it is in contact with roller 28. The roller 26 is moved between these two positions by a first motor (not shown).

Roller 28 is a drive roller and is driven by a second motor (also not shown). A clutch arrangement (not shown) is associated with roller 28 and the second motor, the clutch arrangement slipping when all the film 102 has been unwound from its cassette 100 to prevent the motor from stalling. At this point, the film is still attached to the spool upon which it was initially wound and as a consequence, is in tension due to the action of the roller pair 26, 28. This tension causes the clutch arrangement to slip. Operation of the blade drive station 24 is then initiated.

Once the cassette 100 is correctly positioned as discussed above, i.e. with the film leader positioned between rollers 26, 28, the first motor operates to move roller 26 against roller 28. The second motor then operates to drive roller 28 and the film 102 is pulled out of its cassette 100 and into the storage station 16, along a first film path 36 which extends between the cassette unloading station 12 and the storage station 16, by roller 28 acting against roller 26. The slot in the casing of tire device 10, as mentioned above, is located to coincide with at least the portion of the first film path 36 which extends between the cassette unloading station 12 and the transport rollers 26, 28.

As the film is unwound from its cassette 100, it is transported along path 36 and into storage station 16, its length is checked by the film length checking station 18. This station comprises a pair of spaced apart sensors (not shown in detail) to count or detect the presence of perforations or sprocket holes in the film 102.

Once all the film 102 has been unwound from the cassette 100, the second motor is inactivated and drive to the roller 28 is shut down once the tension in the film causes the clutch arrangement to slip. The blade drive station 24 then comes into operation. This station comprises a guillotine blade 240 driven by a third motor and associated gearbox, shown schematically as 320 in FIGS. 1 and 2, to move in an upwardly direction from the base of the device 10. The blade 240 is moved upwardly by the rotation of the drum 250 under the control of the third motor, and in so doing, cuts through the film 102 at a position adjacent the film unloading station 12 to release it from the spool (not shown) to which it is attached inside the cassette 100. Operation of the blade 240 and its drive station 24 is described hereinafter. The guillotine blade 240 carries a guide 242 adjacent its cutting edge as shown.

Once the film has been cut, the cassette 100 can be discarded from the unloading station 12 and recycled as desired.

It is to be noted that film 102 is not all wound into the storage station 16 as roller 28 is inactivated prior to operation of the blade drive station 24. This means that there is a portion of the film 102 adjacent the newly severed leading edge which is trapped between roller pair 26, 28.

Provided the length of the film exceeds a minimum predetermined value as measured by the film length checking station 18, the second motor is activated once more in the opposite direction so that roller 28, in conjunction with pinch roller 26, will then transport the film 102, with its newly severed end leading, along second film path 38 towards the other pair of transport rollers 30, 32.

The second film path 38 includes a portion of the first film path 36, (namely, the portion between rollers 26, 28 and storage station 16) but the film 102 is driven along it in the opposite direction. The guide 242 attached to the guillotine blade 240 acts to direct the newly severed end of the film 102 up towards film delivery station 14. The rest of the unwound film 102 held in the storage station 16 is driven along the first film path 36 upwardly into the upper portion of the second film path 38 by rollers 26, 28 guide 242 guiding the film 102 along the second path which extends around roller 26.

Transport roller pair 30, 32 comprises a pinch roller 30 and a drive roller 32 in similar fashion to transport roller pair 26, 28. As the film 102 is driven towards roller pair 30, 32, the pinch roller 30 is spaced away from the drive roller 32 and the newly severed leading edge of the film leader can pass therebetween up to the film position checking station 20. Once the presence of the film 102 has been sensed at the checking station 20, the second motor is inactivated and a fourth motor operates to bring the pinch roller 30 into contact with drive roller 32.

The first motor is then operated to lift roller 26 off roller 28 so that the film 102 can be controlled from the roller pair 30, 32.

When the control system of the processing apparatus asks for the film 102, drive is provided to drive roller 32 by a fifth motor (not shown). The film 102 is then driven to the film delivery station 14 for entry into the processing apparatus.

Once the leading edge of the film 102 has been engaged by the drive system of the processing apparatus, the fourth motor operates to lift pinch roller 30 off drive roller 32 and allows the movement of the film to be controlled by the processing apparatus.

Once all the film has been delivered to the processing apparatus, drive to drive roller 32 is stopped, and the guillotine blade 240 is then returned to its rest position in the device 10 by rotating its drive 24 through a further 180° under the control of the third motor.

Figure 2:
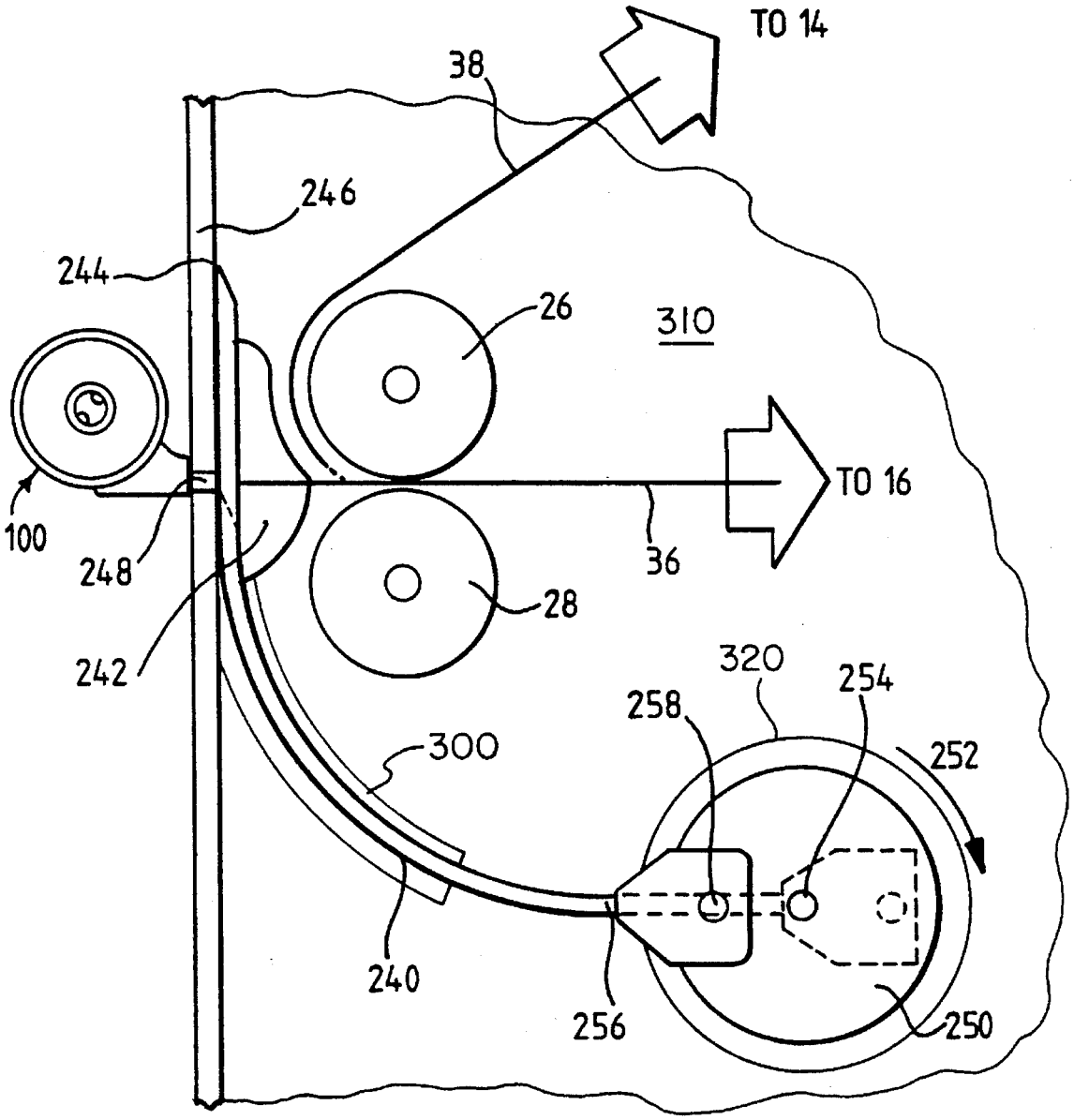
FIG. 2 is an enlarged schematic illustration of the guillotine arrangement.

Referring now in more detail to FIG. 2, a thin, flexible, hardened steel blade 240 having a cutting edge 244 is shown. The blade 240 is curved away from the cutting edge 244, but is substantially straight adjacent thereto.

Grooves 300 are provided in the sideplates 310, only one of which is shown in FIG. 2, of the unloading device 10 to guide the movement of the guillotine blade 240 and its cutting edge 244 between its rest position and its operative position.

As described earlier, the blade 240 carries a guide 242 adjacent its cutting edge 244. The guide 242 is flexibly mounted on the blade 240 and serves to guide the freshly cut end of the film 102 in the right direction after cutting, namely along second film path 38 and towards the film position checking station 20 and film delivery station 14.

The guillotine blade 240 operates against a shear plate 246 during its cutting operation. The shear plate 246 forms one wall of the cassette unloading station 12, and has a slot 248 formed therein through which the film 102 can extend from its cassette 100 to the drive roller pair 26, 28 as described previously.

The guillotine blade 240 is attached to a drum 250 which is rotatable in the direction of arrow 252 about axis 254 by the third motor (mentioned above). The end 256 of the blade 240 remote from the cutting edge 244 is fixed to the drum 250 by a crank pin 258. This allows end 256 to move relative to the drum 250 as the blade 240 moves between its rest and its operative positions and also between its operative and rest positions.

In the position shown in FIG. 2, the blade 240 has been operated by rotating drum 250, in the direction of arrow 252, through an angle of 180° from the position shown in dashed lines. This position shown is dashed lines is the rest position for the blade 240, and the inoperative state for the blade drive station 24.

Once all the film 102 has been tranported to the processing apparatus via the film delivery station 14 and out of the storage station 16, the third motor is activated to rotate drum 250 through a further 180°, in the direction shown by arrow 252, to return the blade 240 to its rest position.

Although the operation of blade drive station 24 and its guillotine blade 240 has been described as being driven by a rotating drum 250 and crank pin 258, any other suitable crank arrangement can be used which allows the third motor to be driven in one direction only whilst allowing the guillotine blade 240 to be reciprocated between its rest and operative positions.

A guillotine arrangement according to the present invention has the following advantages:

a) a greater choice is available for the positioning of the drive arrangement for the blade in relation to the point of cutting;

b) as the blade is curved in the orthogonal plane to its cutting edge, extra stiffness is generated and the blade can be made from thin steel;

c) the film is cut under machine control, and the newly cut end travels first through the processor;

d) the motor driving the guillotine only rotates in one direction and this makes control simpler;

e) the original film leader of the film which may be intact or roughly torn off, is trailed through the processing apparatus and does not therefore have to be manipulated; and f) the film cassette can be re-cycled together with the short length of film retained on the spool.

The guillotine arrangement of the present invention is not limited to film unloading devices, and can be used in any situation where a film sample needs to be cut, for example, in "finishing" operations and sample preparation for film sensitometric testing.

We claim:

1. A cutting device for cutting flexible web material, the device comprising:

a flexible guillotine blade having a front end which includes a cutting edge and a rear end, the blade being mounted so that at least part of the area of the blade between the front end and the rear end has a substantially orthogonal curvature such that the rear end extends in a direction which is substantially orthogonal to the front end, the blade being moveable between a first position and a second position to cut the material;

guide means for forming said substantially orthogonal curvature in the blade and for guiding the movement of the blade between said first and second positions;

a shear plate against which the front end of the blade moves between the first and second positions in a substantially straight path, said blade having a guide member secured at its front end wherein the guide member defines means for guiding the cut material on toward a subsequent stage in a substantially different direction from the original path of the movement of the web; and drive means connected to the rear end of the blade for driving the blade between the first and second positions such that the cutting edge moves along the shear plate, the drive means operating in only one direction to reciprocate the blade by moving it from its first position to its second position and then from its second position to its first position so as to move the cutting edge along the shear plate such that the cutting edge engages and cooperates with the shear plate to cut the flexible web material as the blade moves between the first and second positions.

2. The device according to claim 1 wherein the drive means includes a rotating drum, said rotating drum being connected to the rear end of the blade by a crank pin such that when the drum is rotated in one direction by the drive means, this will effect reciprocation of the cutting edge along the shear plate.

3. A cutting device for cutting flexible web material, the device comprising:

a flexible guillotine blade having a front end which includes a cutting edge and a rear end, said flexible guillotine blade being mounted so that at least part of the area of the blade between the front end and the rear end has a substantially orthogonal curvature such that the rear end extends in a direction which is substantially orthogonal to the front end, the blade being moveable between a first position and a second position to cut the material when the material lies in a first plane, the blade carrying a guide member at its front end adjacent the cutting edge, the guide member having means for guiding the cut material in a substantially different plane to the first plane;

guide means for forming said substantially orthogonal curvature in the blade and for guiding the movement of the blade between the first position and the second position;

a substantially planar shear plate against which the front end of the blade moves during movement between the first position and the second position; and drive means for driving the blade between the first position and the second position such that the cutting edge moves along the shear plate, the drive means being connected to the rear end of the flexible guillotine blade, the drive means moving the rear end of the blade in a direction which is substantially perpendicular to the direction of movement of the front end of the blade so as to reciprocate the blade by moving from its first position to its second position and then from its second position to its first position so as to move the cutting edge along the shear plate such that the cutting edge of the blade engages and cooperates with the shear plate to cut the flexible web material as the blade moves between the first and second positions.

4. The device according to claim 3 wherein the drive means includes a rotating drum, said rotating drum being connected to the rear end of the blade by a crank pin such that when the drum is rotated in one direction by the drive means, this will effect reciprocation of the cutting edge along the shear plate.

* * * * *